US008430692B2

(12) United States Patent
Peng et al.

(10) Patent No.: US 8,430,692 B2
(45) Date of Patent: Apr. 30, 2013

(54) CABLE ASSEMBLY HAVING GROUNDING MEANS

(75) Inventors: Fei-Yan Peng, Shenzhen (CN); Xian-Kui Shi, Shenzhen (CN); Heng Liu, Shenzhen (CN); Chung-Yen Yang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 225 days.

(21) Appl. No.: 12/943,032

(22) Filed: Nov. 10, 2010

(65) Prior Publication Data

US 2011/0111629 A1 May 12, 2011

(30) Foreign Application Priority Data

Nov. 10, 2009 (CN) ..... 2009 2 0314471

(51) Int. Cl.
*H01R 13/648* (2006.01)

(52) U.S. Cl.
USPC ..... 439/607.46; 439/95

(58) Field of Classification Search ..... 439/607.46, 439/76.1, 497, 95; 361/801, 816, 818
See application file for complete search history.

(56) References Cited

U.S. PATENT DOCUMENTS 3,895,267 A * 7/1975 Gordon et al. ..... 361/728
4,408,816 A * 10/1983 Knecht ..... 439/607.41
4,781,624 A * 11/1988 Shepherd ..... 439/620.1
4,855,873 A * 8/1989 Bhargava et al. ..... 361/818
4,889,497 A * 12/1989 Riches ..... 439/76.1
6,045,405 A * 4/2000 Geltsch et al. ..... 439/620.24
6,201,706 B1 * 3/2001 Gustavsen et al. ..... 361/753
6,210,216 B1 * 4/2001 Tso-Chin et al. ..... 439/545
6,210,229 B1 * 4/2001 Lai ..... 439/607.52
6,249,442 B1 * 6/2001 Watanabe ..... 361/801
6,386,919 B2 * 5/2002 Medina et al. ..... 439/607.46
6,471,547 B1 * 10/2002 Venaleck et al. ..... 439/607.06
6,572,402 B2 * 6/2003 Lin ..... 439/490
6,948,949 B1 * 9/2005 Schwartz et al. ..... 439/76.1
7,094,104 B1 * 8/2006 Burke et al. ..... 439/620.01
7,540,773 B2 * 6/2009 Ko ..... 439/581
7,867,040 B2 * 1/2011 Yu et al. ..... 439/701
7,955,132 B2 * 6/2011 Luo ..... 439/607.41

(Continued)

FOREIGN PATENT DOCUMENTS

CN 00115329 3/2004

*Primary Examiner* — Neil Abrams
(74) *Attorney, Agent, or Firm* — Wei Te Chung; Ming Chieh Chang

(57) ABSTRACT

A cable assembly (100) includes an insulative cover (11, 12) defining at least one groove with a front opening; a connector (20) accommodated in the groove, the connector (20) having a terminal module (21) and a metallic shell (22) enclosing the terminal module; a cable (5) electrically coupled to the terminal module of the connector; a printed circuit board (3) received in the insulative cover and electrically connected to the metallic shell of the connector; and a conductive member (4) having a main body (41) fixed to the insulative cover, a connecting portion (42) extending forwardly from the main body and a griping portion (43) formed on a front segment of the connecting portion and griping the printed circuit board to electrically connected with the metallic shell of the connector.

20 Claims, 7 Drawing Sheets

U.S. PATENT DOCUMENTS 8,011,935 B2 * 9/2011 Ko ..... 439/76.1
8,011,961 B2 * 9/2011 Liu et al. ..... 439/607.58
8,118,615 B2 * 2/2012 Peng et al. ..... 439/607.27
8,133,071 B2 * 3/2012 Huang et al. ..... 439/499
8,221,160 B2 * 7/2012 Liu et al. ..... 439/540.1
2010/0068922 A1 * 3/2010 Zhou et al. ..... 439/527
2010/0075544 A1 * 3/2010 Liu et al. ..... 439/701
2010/0291800 A1 * 11/2010 Liu et al. ..... 439/607.58
2011/0111629 A1 * 5/2011 Peng et al. ..... 439/607.35

* cited by examiner

CABLE ASSEMBLY HAVING GROUNDING MEANS

BACKGROUND OF THE INVENTION

1. Field of the Invention

The present invention relates to a cable assembly, more particularly to a cable assembly with improved grounding means.

2. Description of Related Art

Nowadays, an electronic device is lower profile and multifunctional. So accessories are attached to the electronic device, such as cable assembly should be transmitting fast, smaller contour, simplified and friendly usage. USB and Audio jack are commonly input/output interfaces for a computer or other consumer device, and those interfaces are commonly mounted to a cage of a computer or other electronic devices and to link with other peripheral devices. CN Pat. No. 00115329 issued on Mar. 31, 2004 to Ko et al. discloses a cable assembly adapted for mounting to a cage of a computer. The cable assembly includes an external cover and two USB connector enclosed in the external cover. Two bolts are assembled to lateral sides of a front side of the external cover, and a conductive pad with a hole therein is threaded and assembled to each bolt and further contacts a metallic shell of the corresponding USB connector to achieve better grounding function. However, relation between the conductive pad and the metallic shell may loose, after the USB connector mates again and again with its counterpart.

Hence, a cable assembly with improved grounding device is desired.

BRIEF SUMMARY OF THE INVENTION

Accordingly, an object of the present invention is to provide a cable assembly which has reliable grounding means.

In order to achieve the above-mentioned object, a cable assembly in accordance with present invention comprises an insulative cover defining at least one groove with a front opening; a connector accommodated in the groove, the connector having a terminal module and a metallic shell enclosing the terminal module; a cable electrically coupled to the terminal module of the connector; a printed circuit board received in the insulative cover and electrically connected to the metallic shell of the connector; and a conductive member having a main body fixed to the insulative cover, a connecting portion extending forwardly from the main body and a griping portion formed on a front segment of the connecting portion and griping the printed circuit board to electrically connected with the metallic shell of the connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
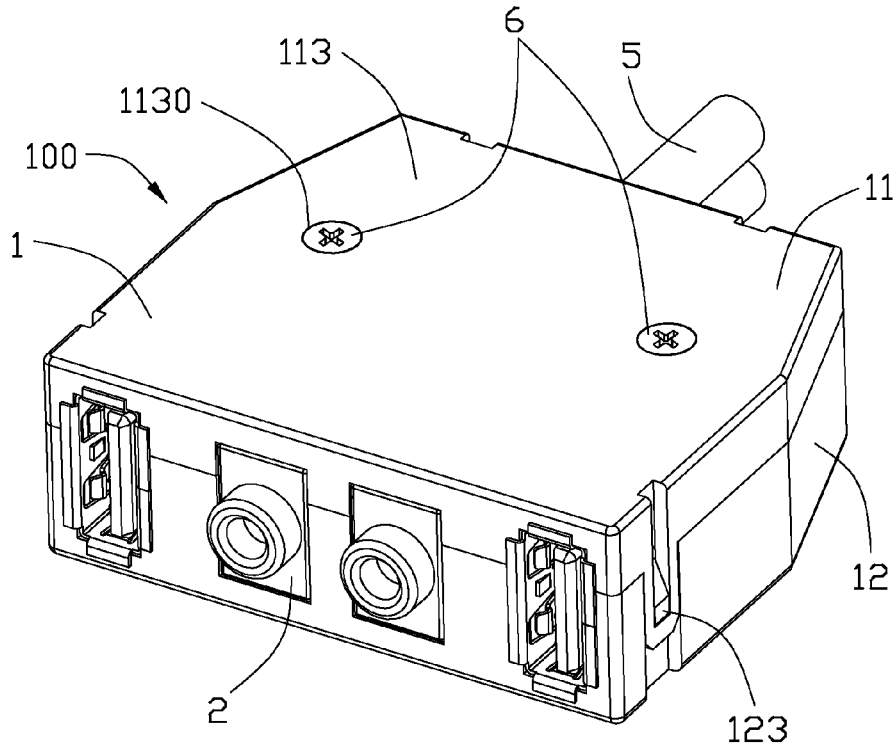
FIG. 1 is an assembled, perspective view of a cable assembly.

In the following description, numerous specific details are set forth to provide a thorough understanding of the present invention. However, it will be obvious to those skilled in the art that the present invention may be practiced without such specific details.

Reference will be made to the drawing figures to describe the present invention in detail, wherein depicted elements are not necessarily shown to scale and wherein like or similar elements are designated by same or similar reference numeral through the several views and same or similar terminology.

Figure 2:
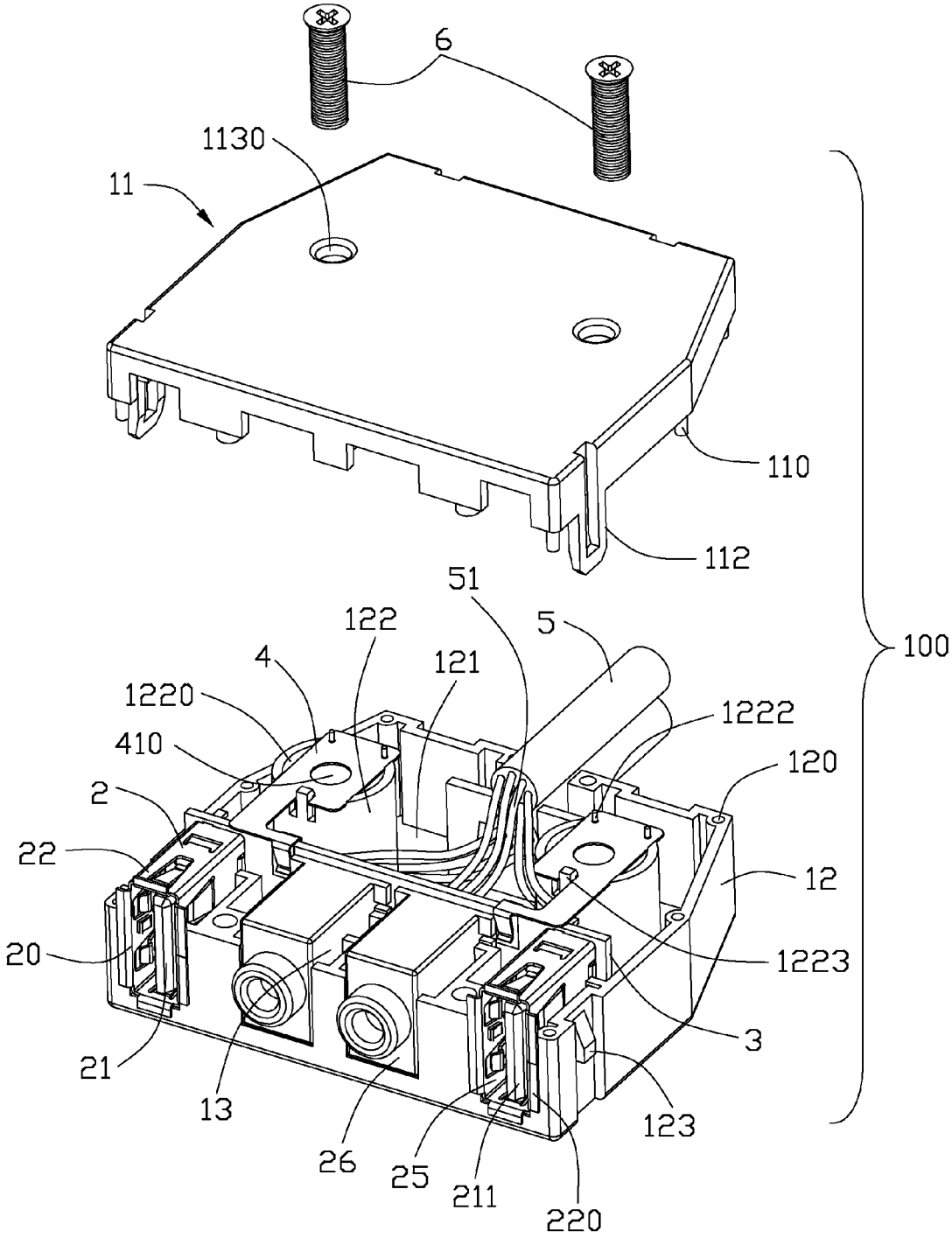
FIG. 2 is similar to FIG. 1, but a top cover is removed upwardly.
Figure 3:
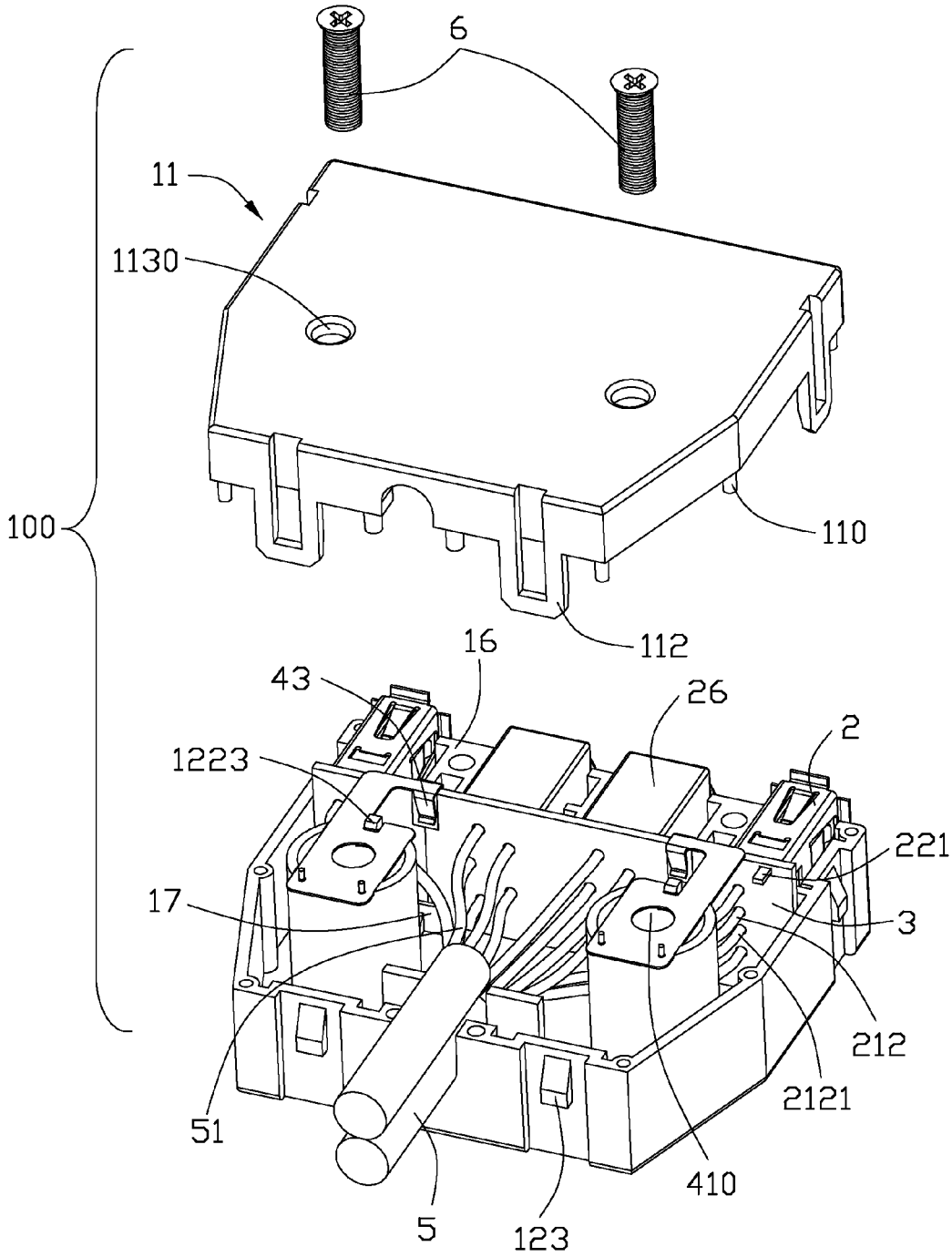
FIG. 3 is similar to FIG. 2, but viewed from other direction.
Figure 4:
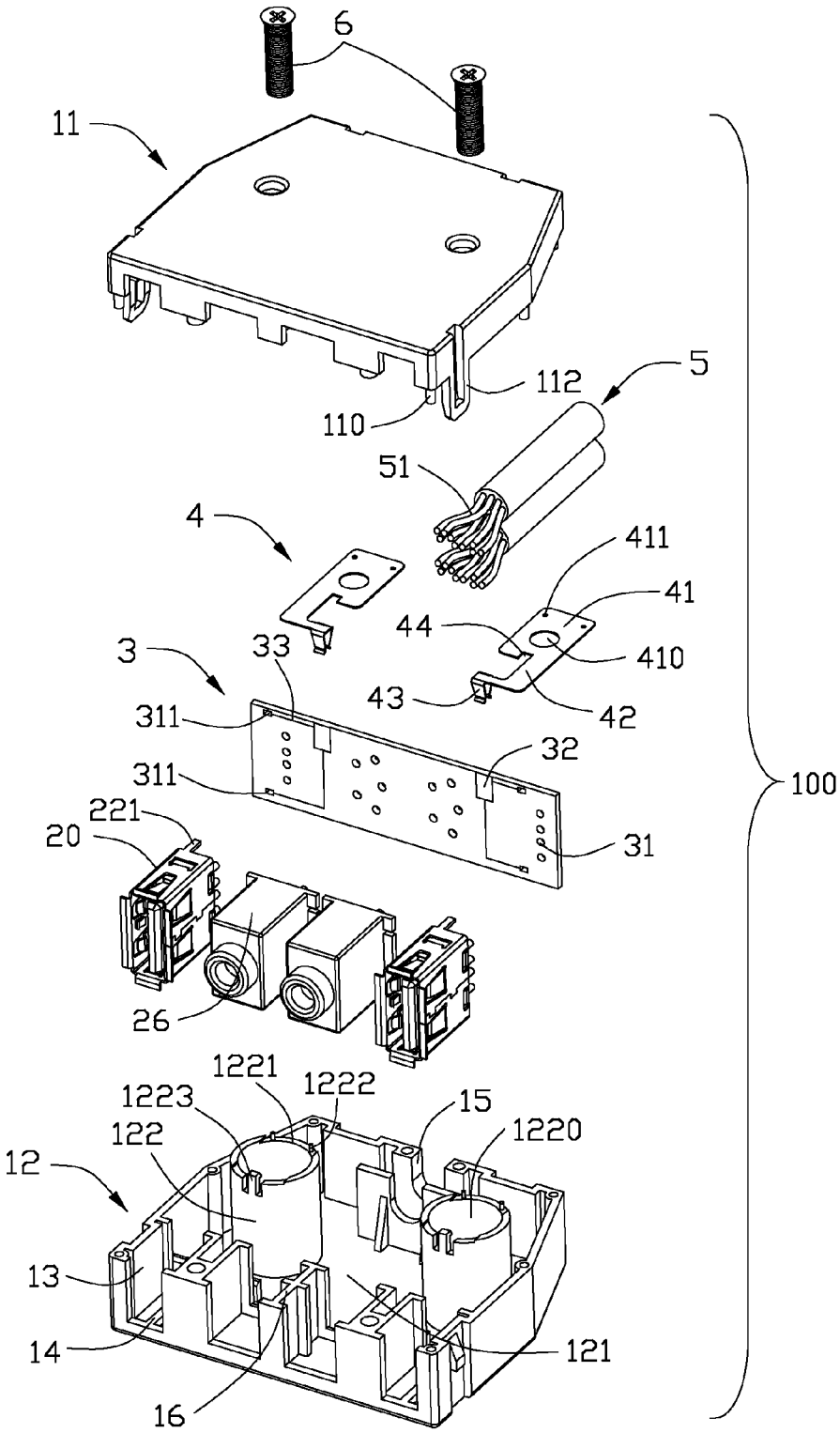
FIG. 4 is an exploded, perspective view of the cable assembly.
Figure 5:
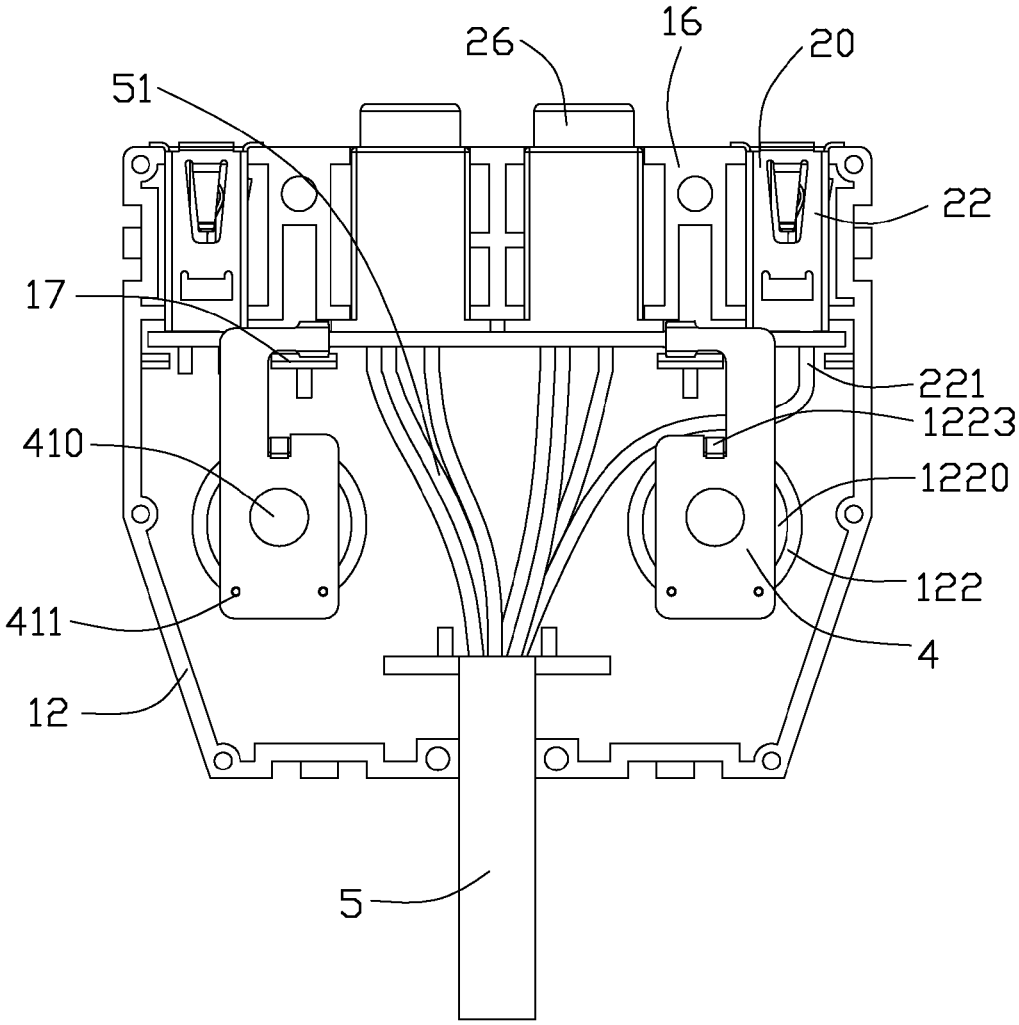
FIG. 5 is top side view of FIG. 2, after the top cover is removed away.
Figure 6:
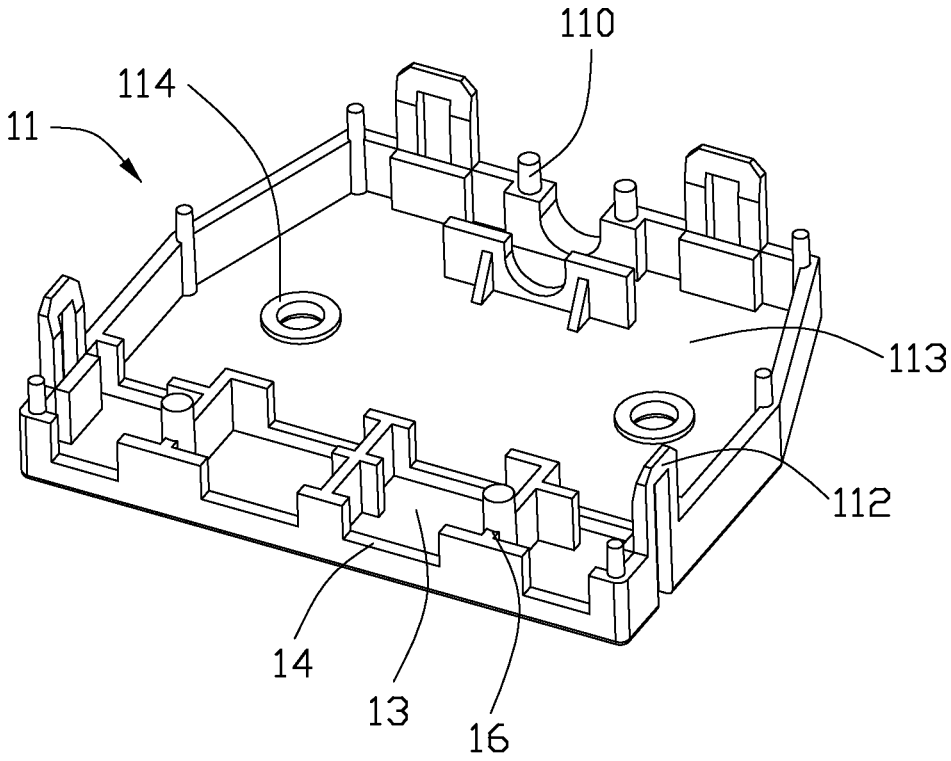
FIG. 6 is a perspective view of the top cover.
Figure 7:
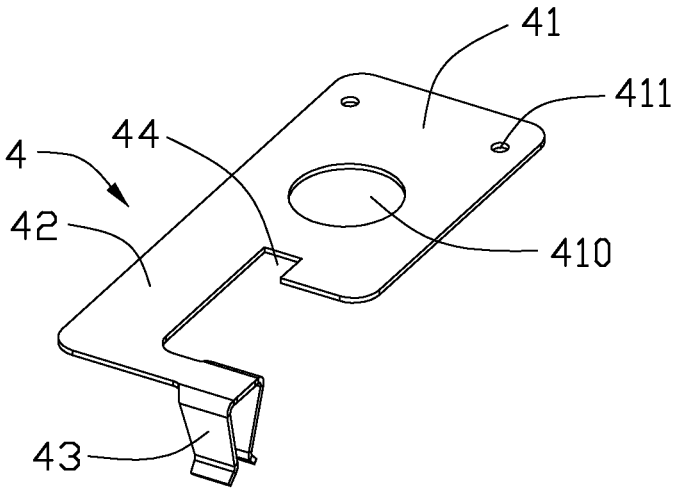
FIG. 7 is perspective view of a conductive member.

Referring to FIGS. 1-7, a cable assembly 100 in accordance with the present invention comprises an insulative cover 1, a number of connectors 2 received in the insulative cover 1, a printed circuit board 3 upstanding in the insulative cover 1, two conductive members 4 fixed to the insulative cover 1 and electrically connected to the connectors 2 via the printed circuit board 3 and a number of cables 5 electrically connected to the connectors 2, respectively. Detail description of these elements and their relationship and other elements formed thereon will be detailed below.

The insulative cover 1 includes a top cover 11 and a bottom cover 12. The top cover 11 and the bottom cover 12 together to form four grooves 13 in front segment thereof and every two adjacent grooves 13 is separated by a spacer 16. Each of the grooves 13 has a front opening 14 which is defined in a front side of the insulative cover 1, and a cable outlet 15 is defined in a back side of the insulative cover 1. A plurality of holes 120 are defined in side walls of the bottom cover 12, and a plurality of posts 110 are formed on side walls of the top cover 11 and inserted into the holes 120, respectively. Two protrusions 123 are formed on outer sides of the side walls of the bottom cover 12, and corresponding clasps 112 are formed on the top cover 11 and latch with the protrusions 123, when the top cover 11 and the bottom cover 12 are combined together. Two first columns 122 are formed on a middle segment of a lower side 121 of the bottom cover 12. The two first columns 122 are separated from each other along a transversal direction. A first through hole 1220 is defined in the first column 122 and the bottom cover 12. Two second columns 114 are formed on an upper side 113 of the top cover 11, and a second through hole 1130 is defined in the second column 114 and the upper side 113. The first through hole 1220 aligns with the second through hole 1130. A cutout 1221 is defined in a tip of the first column 122, and two ribs 1222 are located in the cutout 1221. In addition, there is a hooking portion 1223 formed on the tip of the first column 122 and disposed in front of the two ribs 1222.

The connectors 2 are accommodated in the grooves 13. The connectors 2 includes two audio jacks 26 disposed in juxtaposed manner and two USB connectors 20 respectively arranged at lateral sides of the two audio jacks 26. Each USB connector 2 includes a terminal module 21 and a metallic shell 22 enclosing the terminal module 21. The terminal module 21 and the metallic shell 22 together define a mating port 25 exposed outside of the insulative cover 1 via the front opening 14 thereof. The metallic shell 22 has an expanded front end 220 and two rearwardly extended legs 221 apart from each other along a vertical direction. The terminal module 21 has a dielectric body 211 and a plurality of terminals 212 supported by the dielectric body 211.

The printed circuit board 3 has a plurality of holes 31 to allow tail portions 2121 of the terminals 212 and legs 221 of the metallic shells 22 passing through. The printed circuit board 3 is erectly disposed and sandwiched between the spacers 16 and some blocks 17 located behind the spacers 16. Two metal foils 32 are formed on a top section of a front side of the printed circuit board 3. The hole 31 for receiving the legs 221 of the metallic shell 22 is plated with conductive layer 311, which is electrically connected to the corresponding metal foil 32 by a conductive line 33.

Each of the two conductive members 4 is made of metal sheet and includes a main body 41, a L-shaped connecting portion 42 horizontally extending forwardly from the main body 41 and a griping portion 43 extending downwardly from a front part of the connecting portion 42. The griping portion 43 includes two elastic tabs disposed adjacent to each other and spaced apart from each other along a front-to-back direction. Therefore, the griping portion 43 can clip/grip the metal foil 32 of the printed circuit board 3 and form reliable electrical connection therebetween, without soldering proceeding. A cavity 410 is defined in a middle segment of the main body 41, and two holes 411 are defined in a back segment of the main portion 41 and located behind the cavity 410 to receive ribs 1222 of the first column 122 while the main body 41 of the conductive member 4 is arranged in the cutout 1221 and supported by the first column 122. A notch 44 is defined in a front segment of the main portion 41 and disposed adjacent to the connecting portion 42. The hooking portion 1223 engages with the notch 44 of the conductive member 4. The cavity 410 is smaller than the first through hole 1220 of the first column 122. Further more, the cavity 410 aligns the first through hole 1220 along the vertical direction. The main body 41 is parallel to the lower side 121 of the bottom cover 12 and perpendicular to the printed circuit board 3. Thus, the metallic shell 22, the printed circuit board 3 and the metal member 4 are electrically and mechanically linked together to form an inner grounding line.

Each cable 5 has a number of wires 51 and are respectively soldered to the tail portions 2121 of the terminals 212. The cables 5 exit the insulative cover 5 via the cable outlet 15.

The top cover 11 is assembled to the bottom cover 12, with the second columns 114 standing on the first columns 122. Thus, the metal member 4 is sandwiched between the first columns 122 and the second columns 114.

The cable assembly 100 further comprises two bolts 6 for assembling the cable assembly 100 to a metallic cage of a computer (not shown). Each of the bolts 6 is passed through the second through hole 1130, the cavity 410 and the first through hole 1120 along a direction perpendicular to a mating direction of the cable assembly 100. Thus, the top cover 11 and the bottom cover 12 are fixed with each other by the two bolts 6. And, each of the bolts 6 respectively contacts with the cage of the computer and the metal member 4 which is electrically connected with the printed circuit board 3 and the metallic shell 22. Thus, the cable assembly 100 and the cage of the computer forms a grounding line therebetween by the bolts 6.

In addition, a grounding terminal 212 of the USB connector 20 can be electrically connected to the metal member 4 via the printed circuit board 3 by similar manner as the metallic shell 22 connected with the metal member 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A cable assembly, comprising:

an insulative cover defining at least one groove with a front opening;

a connector accommodated in the groove, the connector having a terminal module and a metallic shell enclosing the terminal module;

a cable electrically coupled to the terminal module of the connector;

a printed circuit board received in the insulative cover and electrically connected to the metallic shell of the connector;

and a conductive member having a main body fixed to the insulative cover, a connecting portion extending forwardly from the main body and a griping portion formed on a front segment of the connecting portion and griping the printed circuit board to electrically connect with the metallic shell of the connector.

2. The cable assembly as claimed in claim 1, wherein the griping portion of the conductive member includes two elastic tabs disposed adjacent to each other and spaced apart from each other along a front-to-back direction.

3. The cable assembly as claimed in claim 2, wherein the printed circuit board is erectly disposed in the insulative cover.

4. The cable assembly as claimed in claim 3, wherein the metallic shell has a leg inserted into a corresponding hole defined in the printed circuit board.

5. The cable assembly as claimed in claim 4, wherein the printed circuit board has a metal foil formed thereon and linked with the corresponding hole via a conductive trace thereof, and the griping portion of the conductive member grips the metal foil.

6. The cable assembly as claimed in claim 1, wherein there is a cavity defined in the main portion of the conductive member and aligning a through hole in the insulative cover along a up-to-down direction.

7. A connector assembly adapted for connecting with at least one cable, the connector assembly comprising:

an insulative cover having a top cover and a bottom cover, the top cover having a first column formed on an upper side thereof and the bottom cover having a second column formed on a lower side thereof;

a connector held by the top cover and the bottom cover;

a printed circuit board electrically connected with the connector; and a conductive member having a main portion, a connecting portion extending forwardly from the main body and a griping portion formed on the connecting portion, the conductive member sandwiched between the first column and a second column, and the griping portion clipping the printed circuit board to electrically connected with the connector.

8. The connector assembly as claimed in claim 7, wherein there is a cavity defined in the main portion of the conductive member and communicating with through holes defined in the insulative cover and the first column and the second column.

9. The connector assembly as claimed in claim 7, wherein there is a hooking portion formed on the first column and engaging with a notch which is defined in a front segment of the main portion.

10. The connector assembly as claimed in claim 9, wherein the notch is disposed adjacent to the connecting portion.

11. The connector assembly as claimed in claim 7, wherein the connecting portion is L-shaped.

12. The connector assembly as claimed in claim 11, wherein the main portion of the conductive member is perpendicular to the printed circuit board.

13. The connector assembly as claimed in claim 12, wherein the connecting portion horizontally extends from the main body and the griping portion downwardly extends from the connecting portion.

14. The connector assembly as claimed in claim 7, wherein there is at least one hole defined in a back segment of the main portion to receive a rib projecting upwardly from the first column.

15. An electrical connector assembly comprising:

a cover including first and second parts assembled to each other and commonly defining a receiving cavity therebetween;

a plurality of connectors disposed in the housing and communicating with an exterior via mating ports thereof, some of said connectors being equipped with a metallic shell;

a printed circuit board on which said connector are mechanically and electrically mounted and to which the metal shell is electrically and mechanically connected;

a columnar structure formed in the receiving cavity, the first part and said second part assembled to each other via a bolt extending into said columnar structure; and a conductive device secured to the columnar structure with an abutment device electrically and mechanically contacting the printed circuit board.

16. The electrical connector assembly as claimed in claim 15, wherein said conductive device includes a clamp clipping the printed circuit board.

17. The electrical connector assembly as claimed in claim 15, wherein said conductive device defines a hole through which said bolt extends.

18. The electrical connector assembly as claimed in claim 15, wherein said printed circuit board is perpendicular to said connectors.

19. The electrical connector assembly as claimed in claim 18, wherein said printed circuit board is parallel to an axle of said columnar structure.

20. The electrical connector assembly as claimed in claim 15, wherein said conductive device is sandwiched between the first part and the second part.

* * * * *